US010888796B1

(12) United States Patent
Darr

(10) Patent No.: US 10,888,796 B1
(45) Date of Patent: Jan. 12, 2021

(54) PLAYHOUSE THAT ATTACHES TO A DOOR

(71) Applicant: Jesse Darr, Findley, OH (US)

(72) Inventor: Jesse Darr, Findley, OH (US)

( * ) Notice: Subject to any disclaimer, the term of this patent is extended or adjusted under 35 U.S.C. 154(b) by 56 days.

(21) Appl. No.: 15/928,683

(22) Filed: Mar. 22, 2018

Related U.S. Application Data

(63) Continuation-in-part of application No. 62/476,644, filed on Mar. 24, 2017.

(51) Int. Cl.
*A63H 33/00* (2006.01)
*E04H 15/02* (2006.01)
*E04H 15/34* (2006.01)

(52) U.S. Cl.
CPC ..... *A63H 33/008* (2013.01); *E04H 15/02* (2013.01); *E04H 15/34* (2013.01)

(58) Field of Classification Search
CPC ..... A63H 33/008; G09F 7/18; G09F 7/22; G09F 2007/1856; A47G 1/1653; E04H 15/02; E04H 15/34
USPC ..... 446/478; 135/90; 211/95, 115–118; 248/214–215; 160/213
See application file for complete search history.

(56) References Cited

U.S. PATENT DOCUMENTS 992,337 A 5/1911 Butler
2,743,023 A * 4/1956 Larson ..... A47G 25/0685 211/96
2,925,916 A * 2/1960 Pollock ..... A47B 61/02 211/119.004
2,940,442 A * 6/1960 Wilhelm ..... A61H 1/0218 602/32
3,605,771 A * 9/1971 Fox ..... E04H 15/006 135/100
4,027,912 A 6/1977 Pacca
4,112,635 A 9/1978 Rylander
4,467,572 A 8/1984 Somers
4,964,249 A 10/1990 Payne
4,976,205 A * 12/1990 Miller ..... D06F 81/06 108/134
5,184,436 A 2/1993 Sadler
5,313,747 A 5/1994 Sakihara
5,352,149 A * 10/1994 Melashenko ..... A47G 5/00 160/135
5,423,709 A 6/1995 Summers
5,989,708 A * 11/1999 Kreckel ..... A47G 1/175 248/205.3
6,108,982 A 8/2000 Davison
6,978,567 B1 * 12/2005 Pearsall ..... G09F 7/18 40/666

(Continued)

*Primary Examiner* — Laura Davison
(74) *Attorney, Agent, or Firm* — Jerry Semer

(57) ABSTRACT

The invention attaches to a door and forms a playhouse. It is one or more panels that fold away from the door. The playhouse is attached to the door by a U-shaped bracket that fits over the top of the door and the bottom. Attached to the bracket is a pole to which the panels of the playhouse are attached. All panels are formed from fabric that is stretched over a frame. All the pieces of the frame are formed with tubes. T connector clamps attach all pieces. Each T connector clamp is a rectangular piece with a bore in one end and a cylindrical opening that passes completely through T connector clamp and is perpendicular to the bore. The cylindrical opening is cut to allow a gap at the bottom of the T connector clamp.

20 Claims, 13 Drawing Sheets

(56) References Cited

U.S. PATENT DOCUMENTS

| | | | | |
|---|---|---|---|---|
| D544,926 | S * | 6/2007 | Kassens | D21/506 |
| 7,976,395 | B2 * | 7/2011 | Healey | A63J 19/00 160/252 |
| 9,283,491 | B2 * | 3/2016 | Pope-Gusev | A63H 33/008 |
| 2016/0158638 | A1 * | 6/2016 | Olsen | A63F 9/14 273/402 |

* cited by examiner

VIEW B—B FROM DRAWING JESSE_6

PLAYHOUSE THAT ATTACHES TO A DOOR

FIELD OF INVENTION

This invention relates to the field of indoor playhouses for children and more particularly to playhouses that attach to a door.

BACKGROUND OF THE INVENTION

Children love playhouses. Playhouses are not only entertaining but also educational. Playhouses spark children's imagination and creativity. The big problem with playhouses is that they take up a great deal of space when they are not in use. Thus, a playhouse needs to be easily disassembled and able to be stored in a compact form. Also, once the playhouse is in storage, it must be able to be reassembled quickly. One of the objectives of this invention is to build a playhouse that assembles effortlessly, disassembled quickly and stored easily. The designer invention accomplished these goals exceedingly well.

The feature that accomplishes this goal is that the invention is a set of panels that attach to a door. The panels have designs on them that resembles a playhouse, such as a fire station, a castle, a police station, a farm, etc. There can be one panel, two panels or more.

The panels are attached to a door such that they can be folded out from the door. If one panel is used, the panel would be moved away from the door to a position approximately perpendicular to the door. The door could even become part of the playhouse. If the door is open, it could be one side of the playhouse that extends out into the room. The panel would be parallel to the wall. If the panel is on the outside of an open closet door, the wall next to the door could be part of the playhouse. If the panel is on the inside of an open closet door, the closet could be part of the playhouse. In this setting, the door could also be covered with a panel to add design to the wall of the playhouse.

If two panels are used, then the second panel would be perpendicular to the first and would be another side to the playhouse. As in the previous set up, the door could become one of the sides of the playhouse. This would create nearly a square house with the two panels and the door creating three sides and the opening to the doorway, or the wall would create the forth side. As in the previous example, if the closet door is used to set up the playhouse, the closet could be used as a second room in the house.

To construct the playhouse, an over the door hook that is attached to the panels is placed over a door. To begin play, the panels are folded away from the door. Thus, the playhouse is assembled in a matter of minutes. At the end of play one just folds the panels against the door. This makes the playhouse easy to create and disassemble. It also enables the playhouse to be compactly stored when not in use. The playhouse when in storage sits up against the door and only takes up the room of the thickness of the panels.

Consequently, this overcomes many disadvantages of a normal playhouse. The inventor playhouse can be easily assembled by just hooking the panels to the door and folding out the panels. The playhouse can also be easily stored when the playhouse playing has ended. The panels are folded against the door. The attribute that accomplished this goal is that the playhouse attaches to the door with an over the door hook. The over the door hook allows the playhouse to be quickly set up. It also enables the playhouse to be packed into a small out of the way area when the playing ends. Another advantage of the invention is that the playhouse can easily be moved and reassembled. To move the playhouse, the panels are folded against the door and then the panels are unsnapped from the over the door hooks at the top and bottom of the bottom of the door. The ability of the playhouse to fold enables the playhouse to be moved around the house easily. All that is necessary is to carry the folded panels and the over the door hooks to a new location. It also enables easy moving of the playhouse if the family decides to relocate.

Another desirable feature for such playhouses is that it has only three parts. All the panels are attached and fold together. Thus, there is no possibility to lose or misplace the parts.

Playhouses have been popular among children for decades. U.S. Pat. No. 4,467,572 to Somers et al. (1984) for example, describes a collapsible children's dwelling with a plurality of pieces hinged together. The structures suffer from the disadvantage of having a plurality of pieces. More recently, U.S. Pat. No. 5,313,747 to Sakihara (1994) illustrates a playhouse made of panels attached to a plurality of hinge-like locking mechanisms. This structure although it has fewer pieces than Somers et al., this structure still suffers from the disadvantage of having too many pieces. Structures such as these are often complex and consequently expensive and complicated to manufacture. Another drawback is the complex assembly of the playhouses. U.S. Pat. No. 4,964,249 to Payne (1990) and U.S. Pat. No. 5,184,436 to Sadler (1993) describe other structures with similar disadvantages. The playhouse described in U.S. Pat. No. 4,112,635 to Rylander (1978) is conveniently one-piece. However, Rylander's playhouse erects with complication. The included hinges increase cost and complexity of manufacturing. Other patents with complicated folding and expensive manufacturing include the play structures described in U.S. Pat. No. 4,027,912 to Pacca (1997), U.S. Pat. No. 992,337 to Butler (1911) and U.S. Pat. No. 5,423,709 to Summers (1995). Summers' dollhouse lacks the capacity to function as a playhouse considering the multiple levels.

SUMMARY OF THE INVENTION

The invention is an article of manufacture that attaches to a door and forms a playhouse. The article of manufacture is one or more panels that fold away from the door. The playhouse is attached to the door by a U shaped bracket the fits over the top of the door. Attached to the bracket is a pole to which the panels of the playhouse are attached. The pole is attached to the bracket by a pole holder clip. The pole snaps into the pole holder clip and is held securely to the bracket. The pole forms one of the sides of the frame of a panel. For more support, another U-shaped bottom bracket is attached to the bottom of the door and the pole.

Attached to pole are panels that are used to form the playhouse. All panels are formed from fabric stretched over a frame. The first panel is attached to a pole. The frame is a rectangular frame with 3 or 4 side pieces. The pole forms one of the sides of the frame. There is also a top piece and another side piece. About halfway down the side, a reinforcement piece runs between the pole and the other side piece. All the pieces are formed by tubes. A T connector clamps attach the pieces at the corner of the frame. The reinforcement piece is also connected to the side pieces by T connector clamps.

T connector clamps are used to form the corners. Each T connector clamp is a rectangular piece of hard plastic with a bore in one end. The bore is of a size that it will securely hold the side pieces in place. At the other end of the T connector clamp is a cylindrical opening that passes completely through T connector clamp and is perpendicular to the bore. The end of the cylindrical opening is cut to allow a gap at the bottom of the T connector clamp. The cylindrical opening is of a size that it will securely hold side pieces in place. However, due to the gap, the side pieces can twist in cylindrical opening. The gap enables the panel to be folded out from or in towards the door. The panel folds against the door.

The panel can fit on either side of the door. The panel can also fit on a closed door or an open door. When the panel is folded out from the open door, the door can become one the side of the playhouse. If panel fits on the front of door and door is open, the wall can become the back of the playhouse. If panel fits on the back of a closet door and the closet door is open, then the closet will become the back room of the playhouse.

The playhouse could also have two panels. The door panel forms the previous embodiment attaches to the door by the same method as the previous embodiment. The new panel attaches to the door panel via the other side piece of the door panel. Just as in the previous embodiment the panel is a frame which includes the other side piece of the previous embodiment, a side piece, a top piece and a reinforcement piece. These pieces are attached just as in the previous embodiment. The new panel can fold out from the door panel the same way the door panel folds out from the door. A third panel could also be added. The third panel would attach to the new panel by the same method the new panel attaches to the door panel. The third panel is a frame just like the new panel and the door panel. The third panel can be folded out from the new panel just like the new panel can be folded out from the door. When playing with the panels can be folded out from the door in numerous different patterns.

The panels are stretched with fabric. In the preferred embodiment, this fabric is nylon. The fabric is printed with designs. The fabric can also be cut out to form doors, windows, etc. The design could be a generic playhouse with doors and windows. Or the design could have a specific theme such as a fire station, a castle, a police station, a farm, etc.

DETAILED DESCRIPTION OF THE PREFERRED EMBODIMENT

Figure 1:
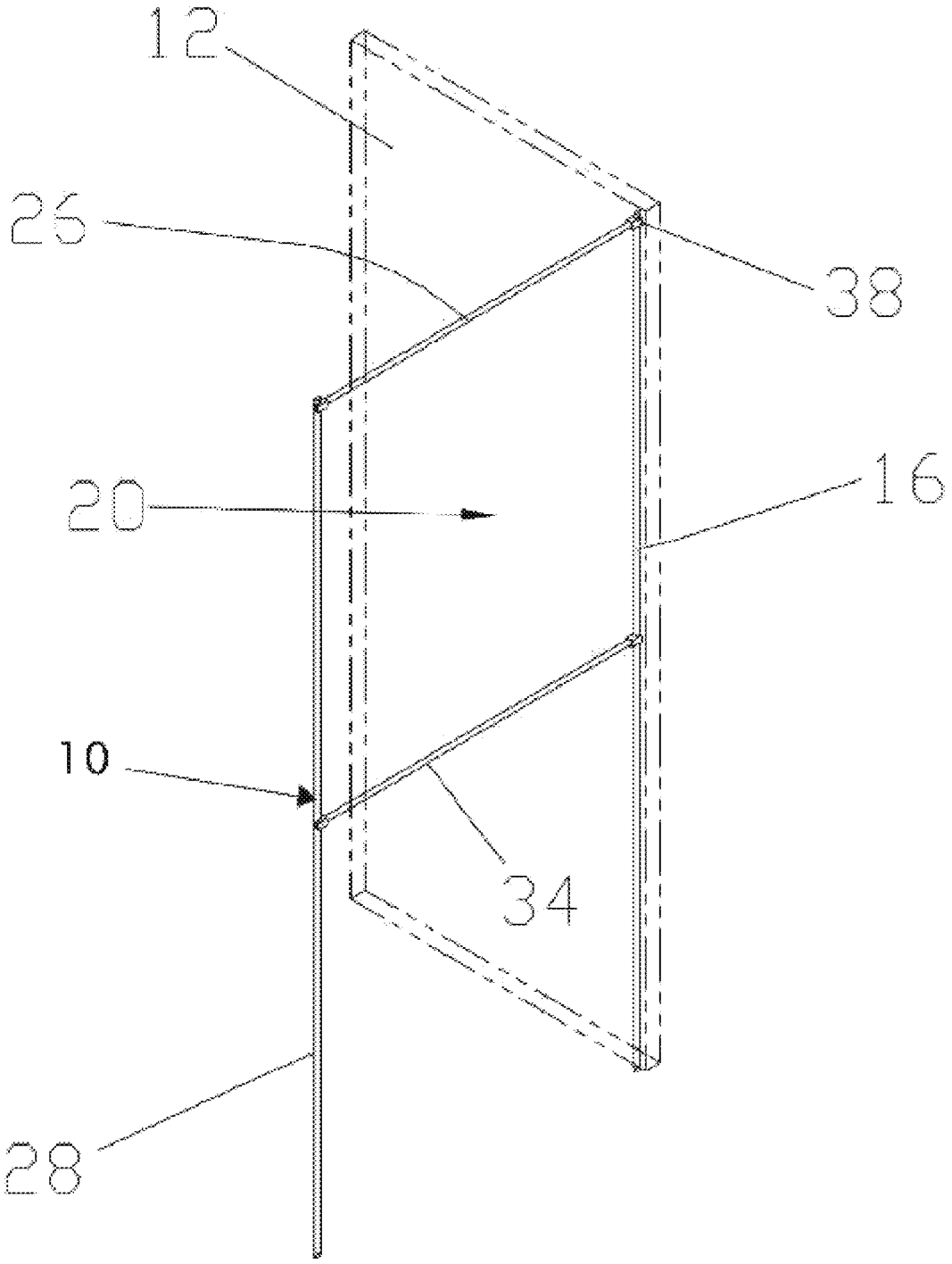
FIG. 1 is a perspective view of the frame of the panel.
Figure 2:
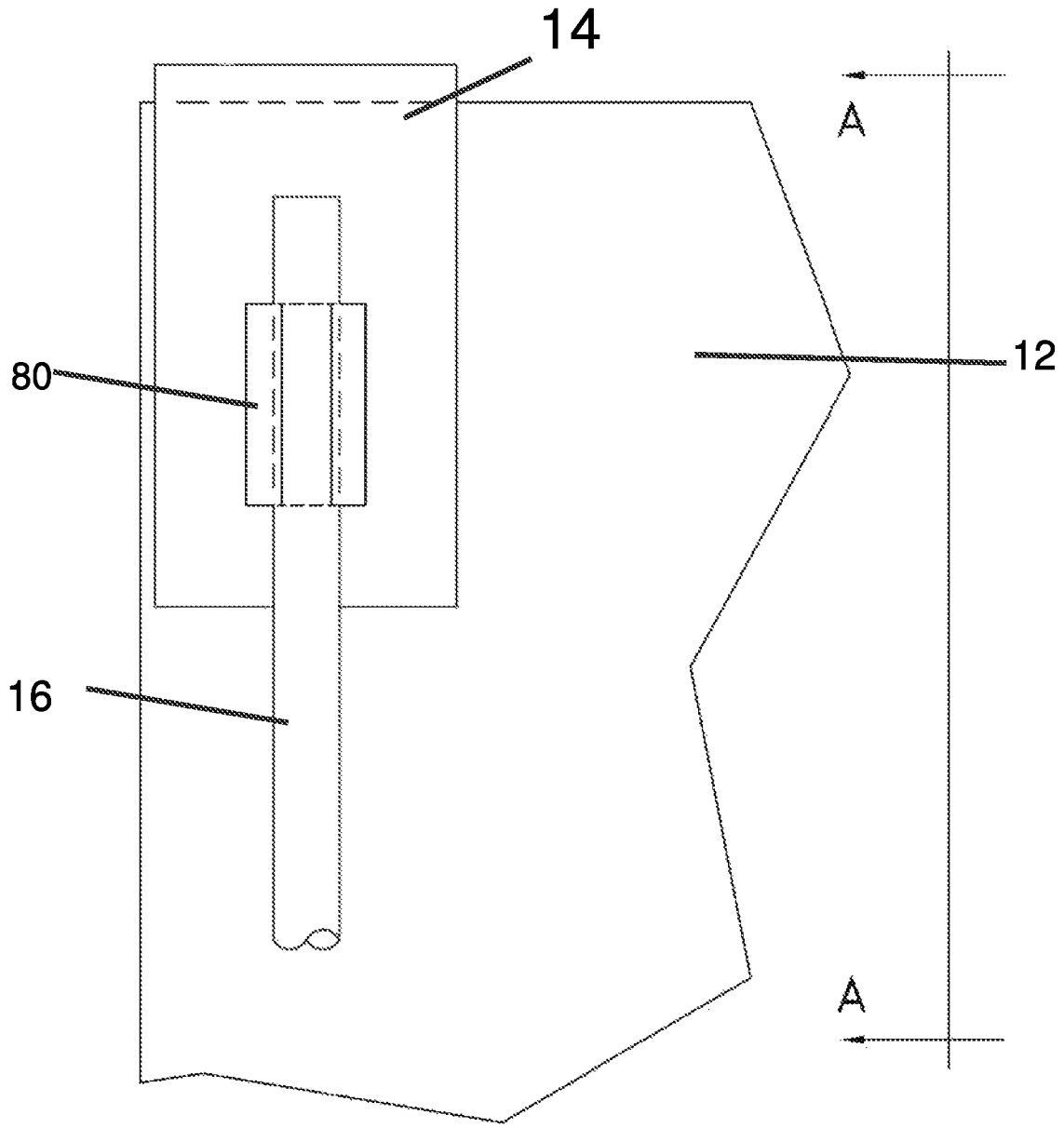
FIG. 2 is a front view of the over the door U-shaped bracket on the door.
Figure 3:
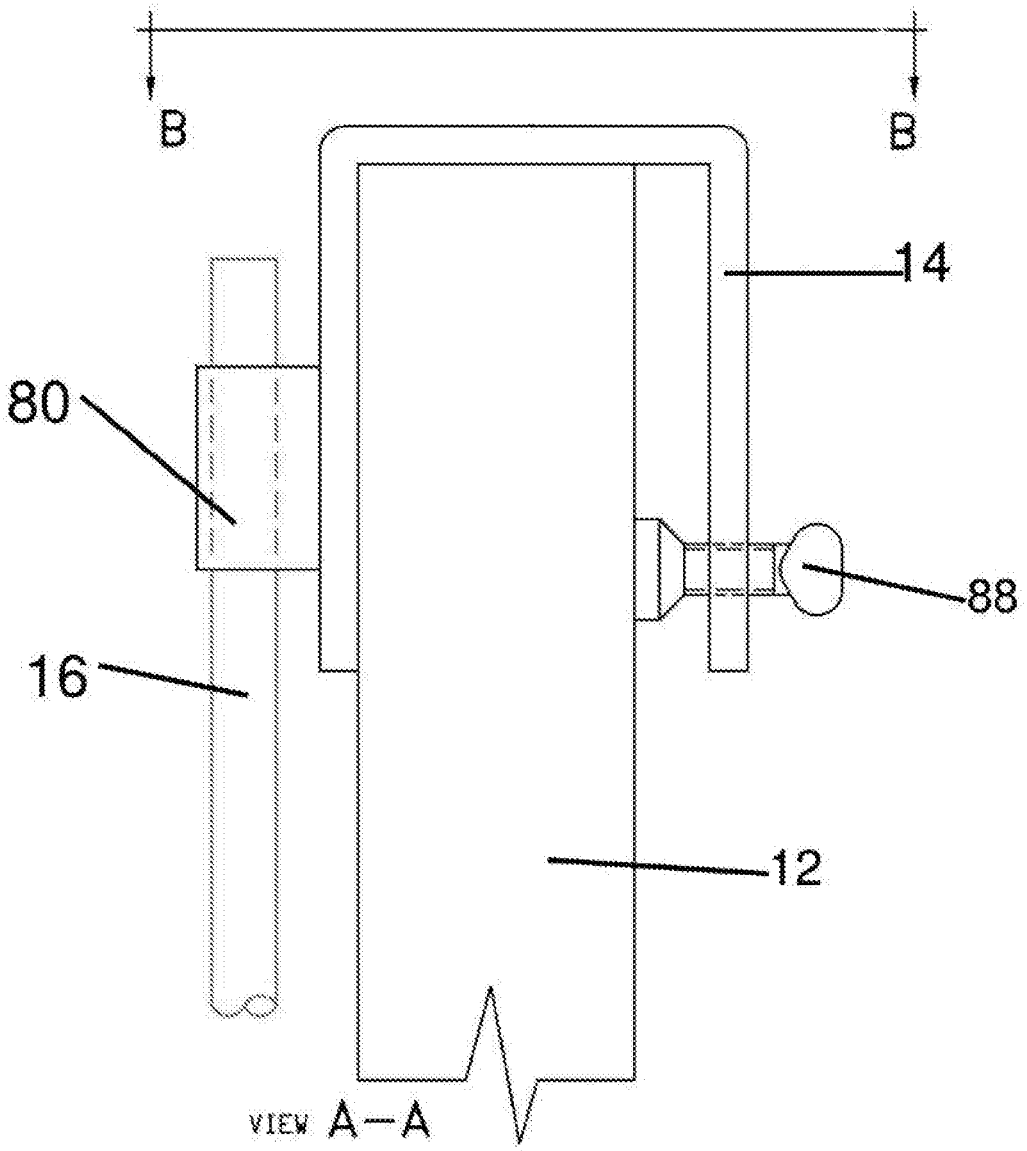
FIG. 3 is a sectional view along A-A of FIG. 2.

FIG. 1 is a view of the invention 10 with the invention 10 attached to a door 12. In the preferred embodiment, invention 10 is attached to door 12 with a bracket 14 and a pole 16 shown in FIG. 2. FIG. 3 is a sectional view along A-A of FIG. 2 and shows bracket 14 fitting over the top of the door 12. Bracket 14 is a U-shaped bracket. The opening in the U-shaped bracket 14 is wider than the door. When the U-shaped bracket 14 is placed over the door 12, it is tightened against the door by a thumb screw 88.

Figure 4:
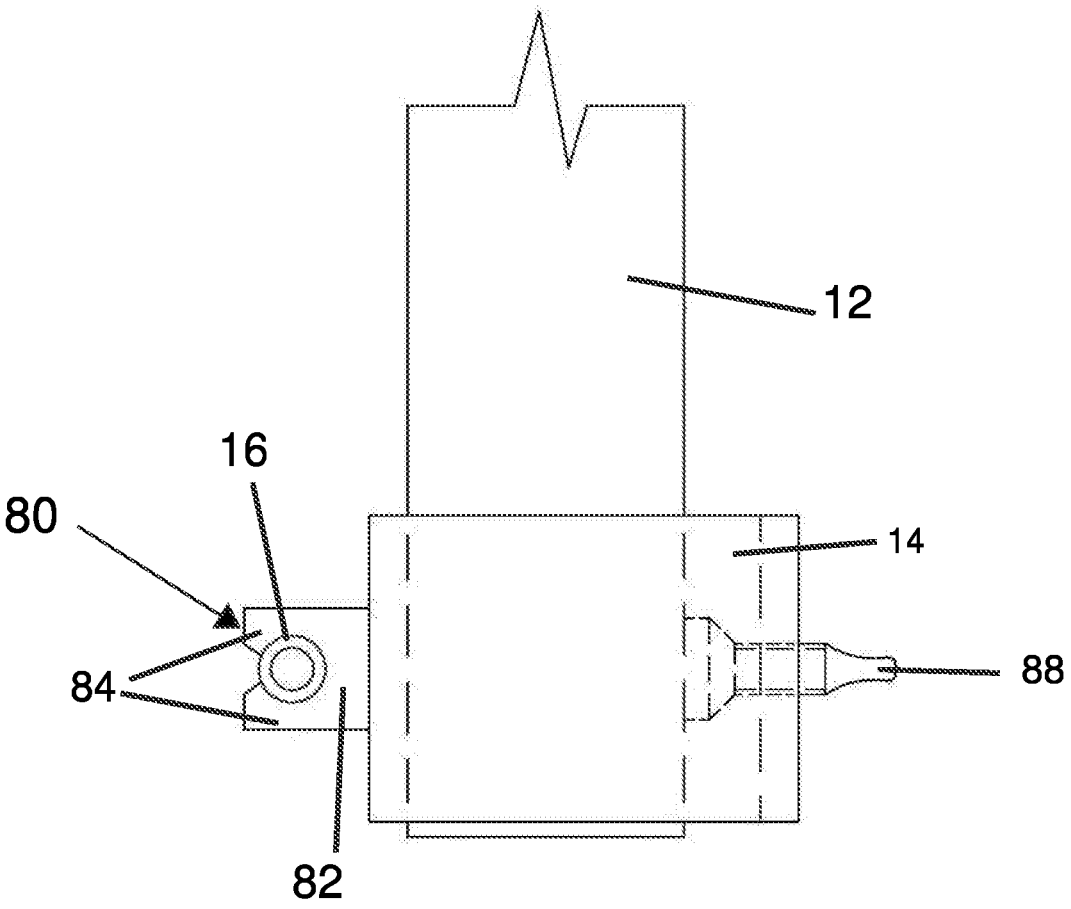
FIG. 4 is a sectional view along B-B of FIG. 3.

Attached to the front of the U-shaped bracket 14 is a pole 16. Pole 16 attaches to a pole holder clip 80. FIG. 4 is a sectional view along b-b of FIG. 3. Pole holder clip 80 has semicircular back section 82 and arms 84 that are resilient and extends forward from back section 82, as shown in FIG. 4. The pole 16 snaps between arms 84 and into the circular opening that is formed by back section 82 and arms 84. To attach the pole 16, the pole 16 is pushed through the opening between the resilient arms 84 and moves outward and then inward fully encircling the pole 16. For more support, another U-shaped bottom bracket 14 can be attached to the bottom of the door 12 and pole 16 as shown in FIG. 6.

Attached to pole 16 are panels that are used to form the playhouse. All panels 20, 50 and 70 are formed from nylon fabric 22 that is stretched over the panels. The first panel 20 is attached to pole 16.

In the preferred embodiment, the panel 20 is a rectangular frame with three side pieces. FIG. 1 shows the frame is made of three side pieces 26, 28, and 16. In the preferred embodiment, reinforcement piece 34 is placed in the middle of the frame as shown in FIG. 1.

Figure 6:
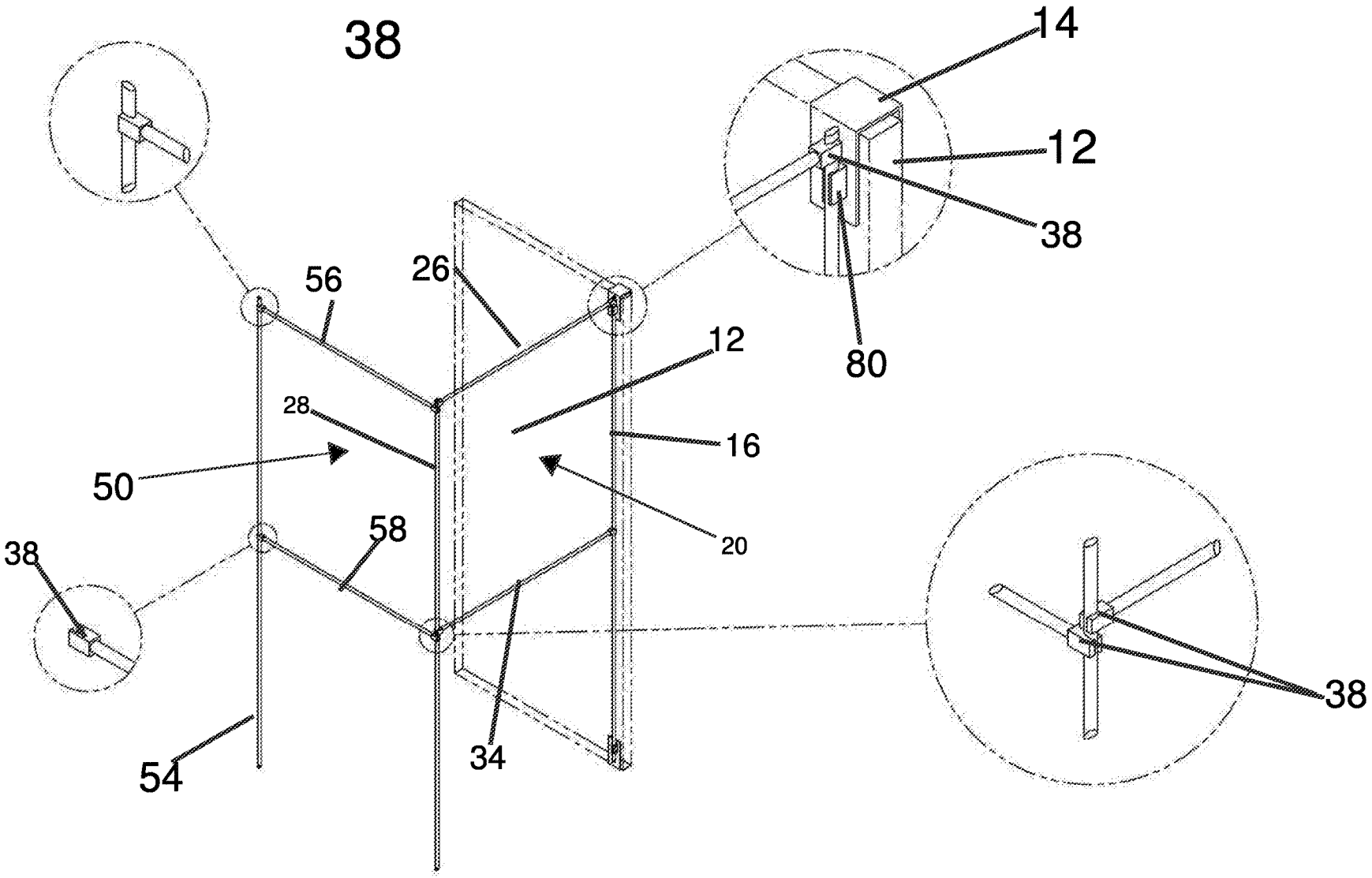
FIG. 6 is a perspective view of another embodiment of the invention with two frames.

The side pieces 26, 28, 16 connects to T connector clamps 38 at the corners of the frame as shown in FIG. 6. The reinforcement piece 34 connects to the side pieces by T connector clamps 38.

Figure 5:
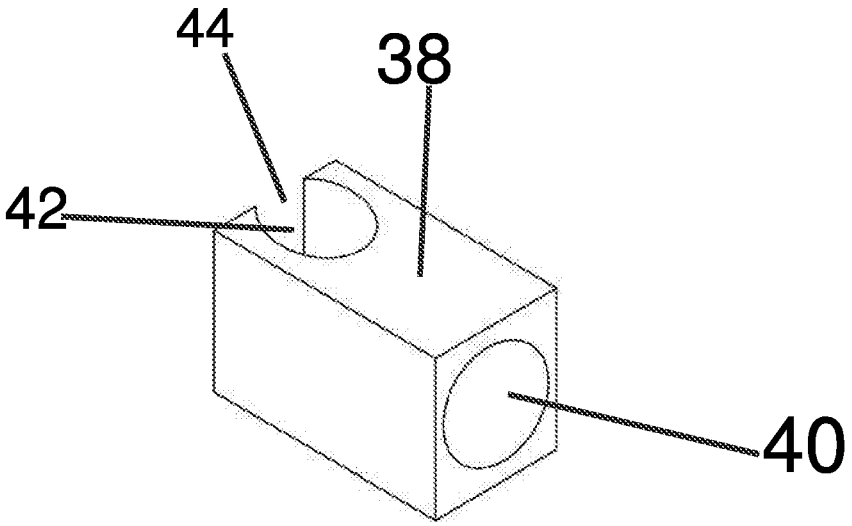
FIG. 5 is a perspective view of the T connector clamp.
Figure 5A:
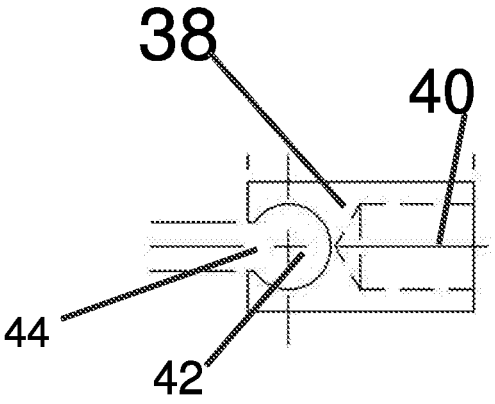
FIG. 5A is a top view of the T connector clamp with the bore in phantom.
Figure 5B:
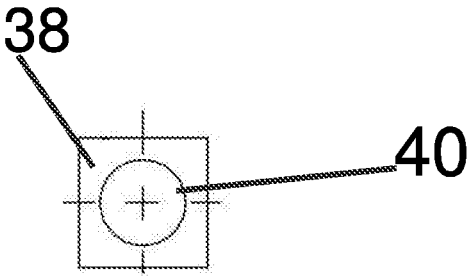
FIG. 5B is a side view of the T connector clamp.

FIG. 5 is a perceptive view of the T connector clamps 38. FIG. 5A is a top view with the bore 40 in phantom. FIG. 5B is a side view on the side with the bore 40. Each T connector clamp is a rectangular piece of hard plastic with a bore 40 in one end. Bore 40 is of a size that it will securely hold side pieces 26, 28, 16, and 34 in place. At the other end of the T connector clamp 38 is a cylindrical opening 42 that pass completely through T connector clamp 38 and is perpendicular to the bore 40. The end of the cylindrical opening 42 is cut off to allow a gap 44 at the bottom of the T connector clamp 38 as shown in FIGS. 5 and 5 A. The cylindrical opening 42 is of a size that it will securely hold side pieces 26, 28, 16, and 34 in place. However, due to gap 44, the side pieces 26, and 16, can twist in cylindrical opening 42.

The T connector clamp 38 is also used to attach panel 20 to the pole 16 on the door 12 as shown in FIG. 6. The gap 44 enables the panels 20 to be folded against the door or folded away from the door and out into the room. To attach panel 20 to pole 16 one end of side piece 26 is placed in bore 40 of T connector clamp 38. The cylindrical opening 42 of T connector clamp 38 is at the top of pole 16. The bore 40 of another T connector clamp 38 is on side piece 26. Side piece 28 is placed in the cylindrical opening 42 of this T connector clamp 38. Side piece 28 runs parallel to pole 16. Reinforcement piece 34 is then placed between side piece 28 and pole 16. Reinforcement piece 34 is attached to pole 16 with another T connector clamp 38. One end of reinforcement piece 34 is a placed in bore 40 of T connector clamp 38. Pole 16 is placed in cylindrical opening 42 of this T connector 38. The other end of reinforcement piece 34 is located in bore 40 of another T connector clamp 38. The cylindrical opening 42 of this T connector clamp 38 is on pole 28. This places panel 20 on pole 16. Panel 20 is made with side pieces 26 and 28, reinforcement piece 34 and pole 16. The two T connectors clamp 38 that attach pole 16 to the frame of panel 20 enable panel 20 to fold out from door 12 and fold into door 12. The gap 44 in the cylindrical opening 40 allows pole 16 to twist within the two T connector clamps 38.

Panel 20 can fit on either side of the door 12. Panel 20 can also mount on a closed door 12 or an open door 12. When panel 20 is folded out from the open door 12, the door 12 can become one the side of the playhouse. If panel 20 fits on the front of door 12 and door 12 is open, the wall can become the back of the playhouse. If panel 20 fits on the back of a closet door 12 and the closet door 12 is open, then the closet could become the back room of the playhouse.

FIG. 6 shows another embodiment of the invention. FIG. 6 has two panels 20 and 50. Panel 20 folds out from door 12. Panel 50 folds out from panel 20. When the playhouse is not in use, panel 20 folds against door 12 and panel 50 folds against panel 20.

In FIG. 6 panel 20 is attached to the door 12 by the same method as panel 20 is attached to door 12 in FIG. 1. Panel 50 is then attached to panel 20. Panel 50 is formed by side pieces 28, 56, and 54 and reinforcement piece 58. Panel 50 and panel 20 have the same common side piece 28. To attach panel 50 to panel 20, one end of side piece 56 is placed in bore 40 of a T connector clamp 38. The cylindrical opening 42 of T connector clamp 38 is positioned at the top of common side piece 28. The bore 40 of another T connector clamp 38 is located on the other end of side piece 56. Side piece 54 is positioned in the cylindrical opening 42 of this T connector clamp 38. Side piece 54 runs parallel to side piece 28. Reinforcement piece 58 is then placed between side piece 54 and side piece 28. Reinforcement piece 58 is attached to side piece 28 with another T connector clamp 38. One end of reinforcement piece 58 is a placed in bore 40 of T clamp 38. Side piece is put in cylindrical opening 42 of this T connector clamp 38. The other end of reinforcement piece 58 is located in bore 40 of another T connector clamp 38. The cylindrical opening 42 of this T connector 38 is placed on side piece 54. This places panel 50 on panel 20. Panel 50 is made with side pieces 54, 56 and 28, reinforcement piece 58. The T connectors clamp 38 that attach side piece 28 to panel 50 enable panel 50 folds out from panel 20 and folds into panel 20. The gap 44 in the cylindrical opening 40 enables side piece 28 to twist within the two connectors clamps 38. Panel 50 can twist around side piece 28 more than 180°.

Panel 20 and 50 can fit on either side of the door 12. Panel 20 and 50 can also fit on a closed door 12 or an open door 12. When panel 20 and 50 is folded out from the open door 12, the door 12 can become one side of the playhouse with the panels becoming one or two sides. If panel 20 and 50 fit on the front of door 12 and door 12 is open, the wall can become the back of the playhouse with the other two panels becoming the sides. If panel 20 and 50 fits on the back of a closet door 12 and the closet door 12 is open, then the closet will become the back room of the playhouse.

Figure 7:
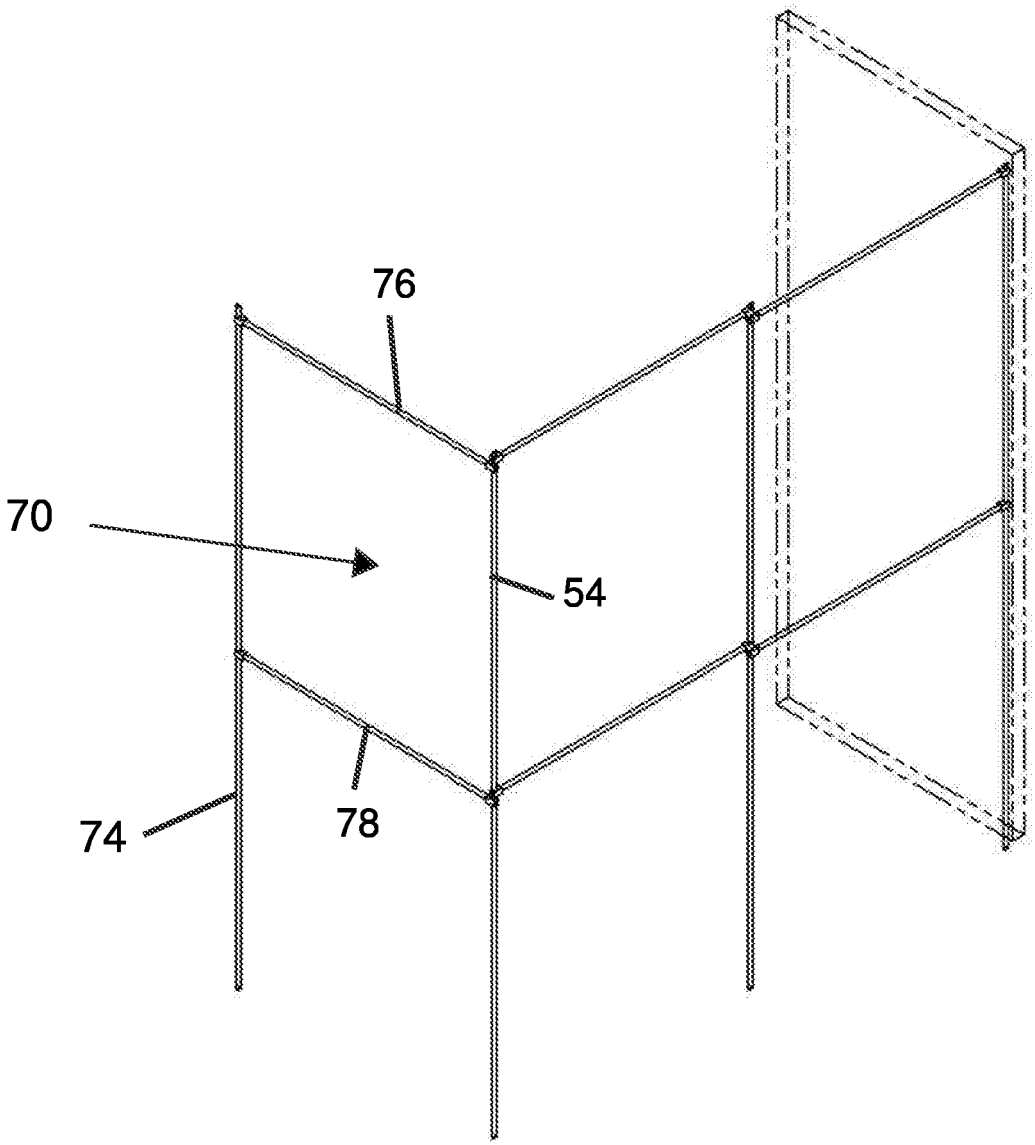
FIG. 7 is a perspective view of another embodiment of the invention three frames.

FIG. 7 shows another embodiment of the invention. FIG. 7 has three panels 20, 50 and 70. Panel 20 folds out from door 12. Panel 50 folds out from panel 20. Panel 70 folds out from panel 50. When the playhouse is not in use, panel 20 folds against door 12, panel 50 folds against panel 20, and panel 70 folds against panel 50.

In FIG. 7 panel 20 is attached to the door 12 by the same method as panel 20 is attached to door 12 in FIG. 6. Panel 50 is then attached to panel 20. Panel 50 is attached to panel 20 in the same manner as panel 50 is attached to panel 20 in FIG. 6. Panel 70 is formed by side pieces 54, 76, and 74 and reinforcement piece 78. Panel 70 and panel 50 have the same common side piece 54. To attach panel 70 to panel 50, one end of side piece 76 is positioned in bore 40 of a T connector clamp 38. The cylindrical opening 42 of T connector clamp 38 is put at the top of common side piece 54. The bore 40 of another T connector clamp 38 is located on the other side piece 76. Side piece 74 is positioned in the cylindrical opening 42 of this T connector clamp 38. Side piece 74 runs parallel to side piece 54. Reinforcement piece 78 is then placed between side piece 74 and side piece 54. Reinforcement piece 78 is attached to side piece 54 with another T connector clamp 38. One end of reinforcement piece 78 is a placed in bore 40 of T connector clamp 38. Side piece 54 is set in cylindrical opening 42 of this T connector clamp 38. The other end of reinforcement piece 78 is placed in bore 40 of another T connector 38. The cylindrical opening 42 of this T connector 38 is located on side piece 74. This places panel 70 on panel 50. Panel 70 is made with side pieces 74, 76 and 54, reinforcement piece 78. The T connectors 38 that attach side piece 54 to the frame of panel 70 enable panel 70 folds out from panel 50 and folds into panel 50. The gap 44 in the cylindrical opening 40 enables side piece 54 to twist within the two connectors 38. Panel 70 can twist around side piece 54 more than 180°.

Panel 20, 50 and 70 of FIG. 7 can fit on either side of the door 12. Panel 20, 50 and 70 can also fit on a closed door 12 or an open door 12. When panel 20, 50 and 70 are folded out from the open door 12, the door 12 can become one the side of the playhouse with the panels becoming one or two sides. If panels 20, 50 and 70 fit on the front of door 12, and door 12 is open, the wall can become the back of the playhouse with the other three panels becoming the sides. If panel 20, 50 and 70 fits on the back of a closet door 12 and the closet door 12 is open, then the closet will become the back room of the playhouse.

Figure 8A:
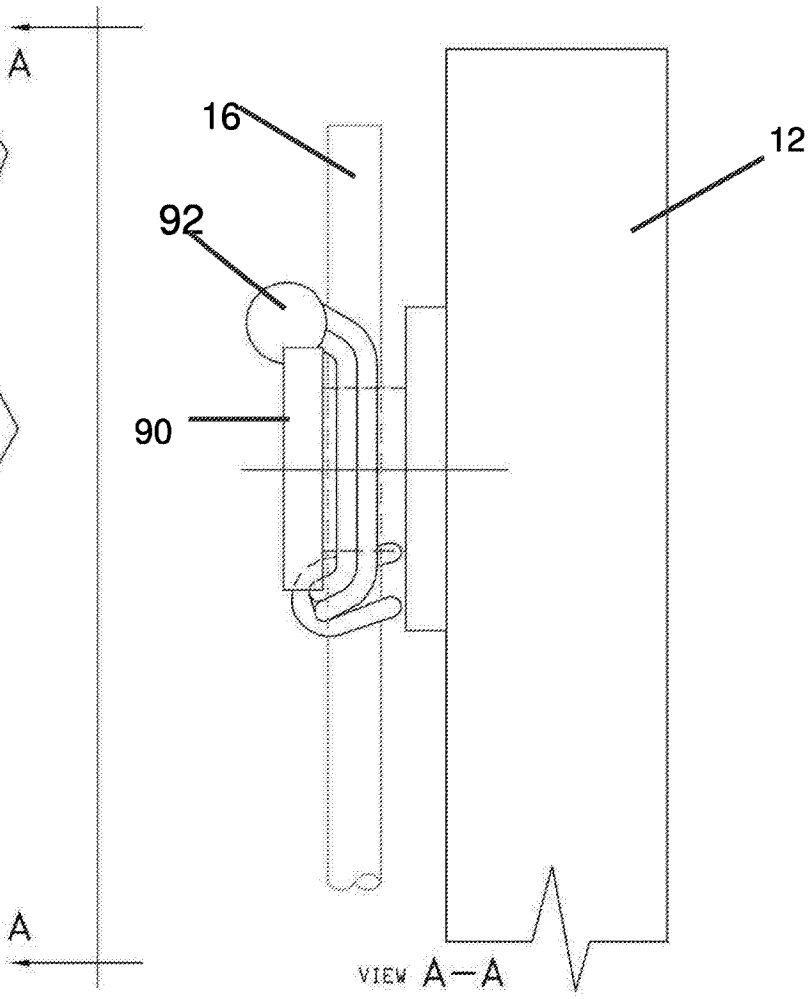
FIG. 8A is a sectional view along A-A of FIG. 8.
Figure 8:
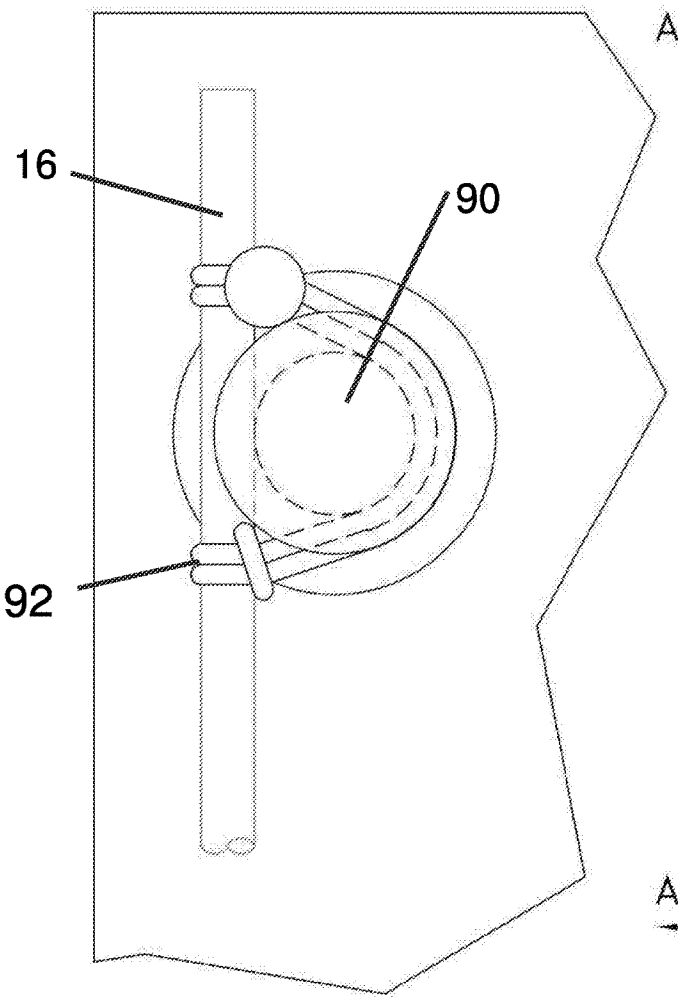
FIG. 8 is another embodiment of the invention with a different method to attach the playhouse to the door.

FIG. 8 shows another way to attach the pole 16 to the door 12. FIG. 8A is a view along A-A of FIG. 8. In FIGS. 8 and 8A, knob 90 is positioned on the door 12. In the preferred embodiment, knob 90 is self-adhesive knob which sticks to the door but can be easily removed. In the preferred embodiment, knob 90 has self-adhesive made by 3M Company Command Brand™. The knob 90 is placed near the top of the door 12. Pole 16 is positioned next to knob 90. A ball bungee snuggler 92 is looped securely around pole 16. Then the ball bungee snuggler 92 wrapped around knob 90 and finally ball bungee snuggler 92 is looped around pole 16 and secured as shown in FIG. 8. This holds pole 16 securely against knob 90. In the preferred embodiment, another knob 90 is placed near the bottom of the door 12 and near the bottom of a pole 16. The knob 90 at the bottom of the door 12 is secured to pole 16 with the ball bungee snuggler 92 as the knob 90 at the top of the door 12. This method of attachment of pole 16 to a door 12 works especially well with pocket or bifold doors.

Figure 9:
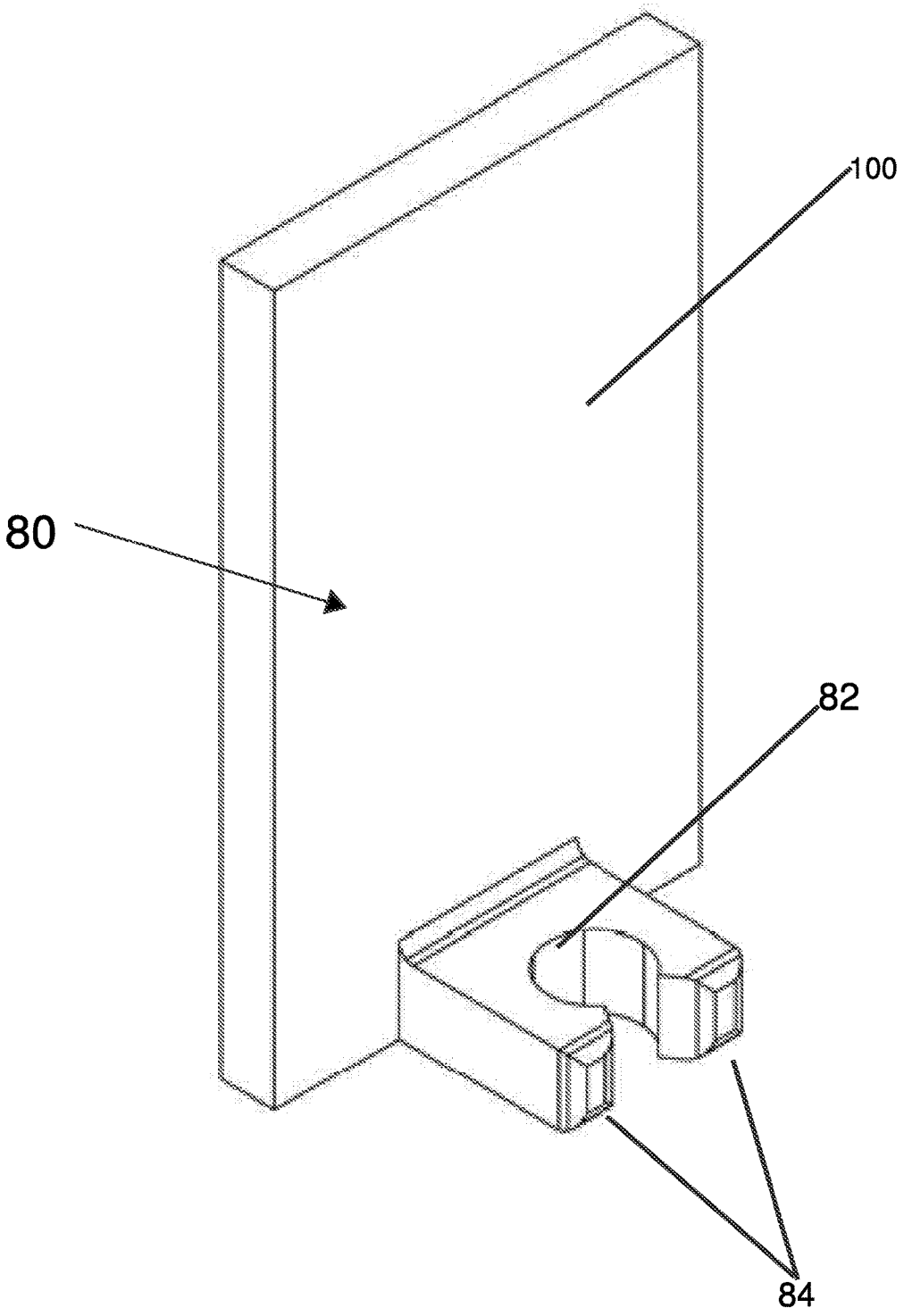
FIG. 9 is a perspective view of a third method to attach the playhouse to the door 12.
Figure 9A:
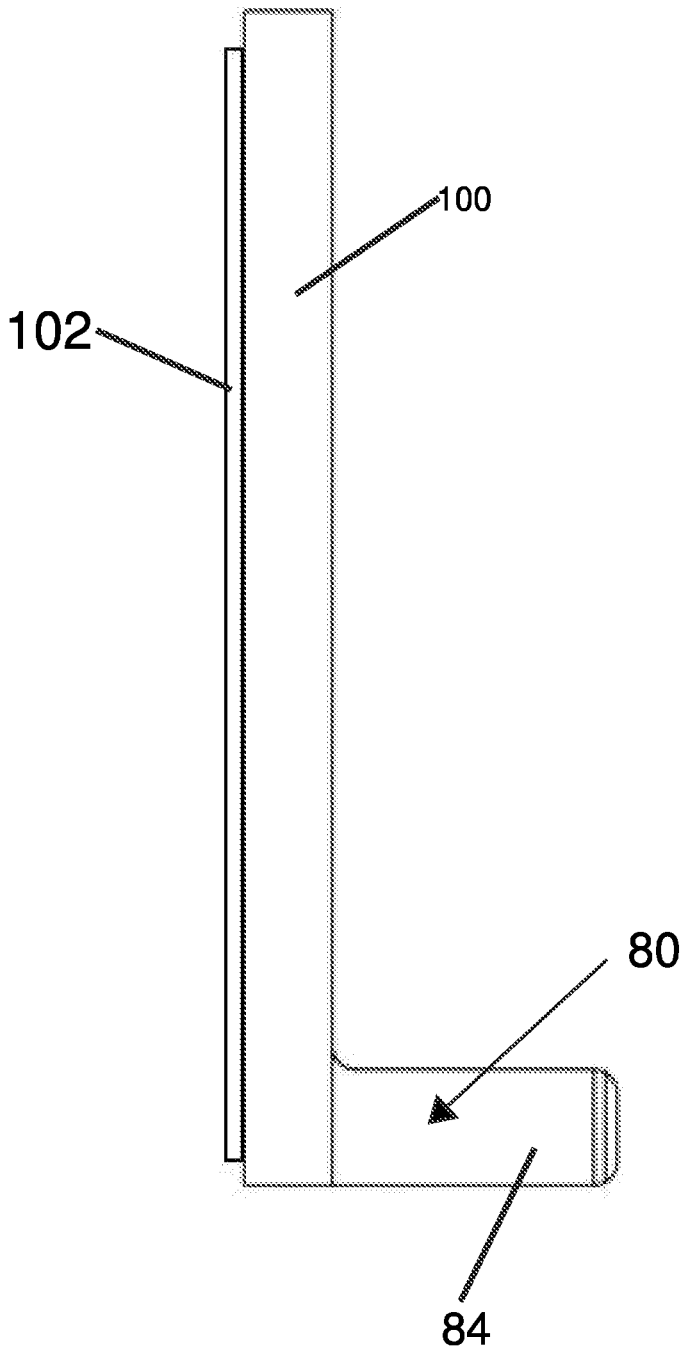
FIG. 9A is a top view of the third method to fasten the playhouse to the door.
Figure 9B:
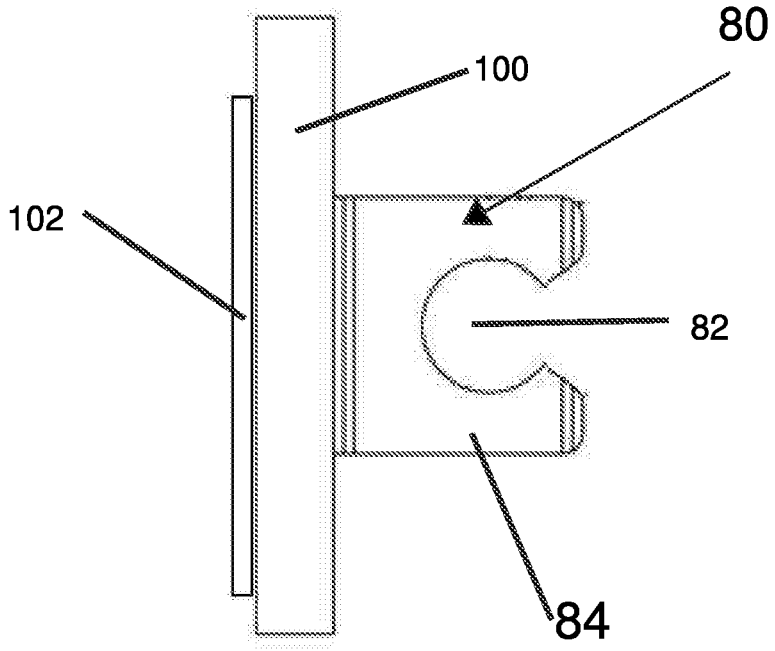
FIG. 9B is a side view of the third method to connect the playhouse to the door.
Figure 9C:
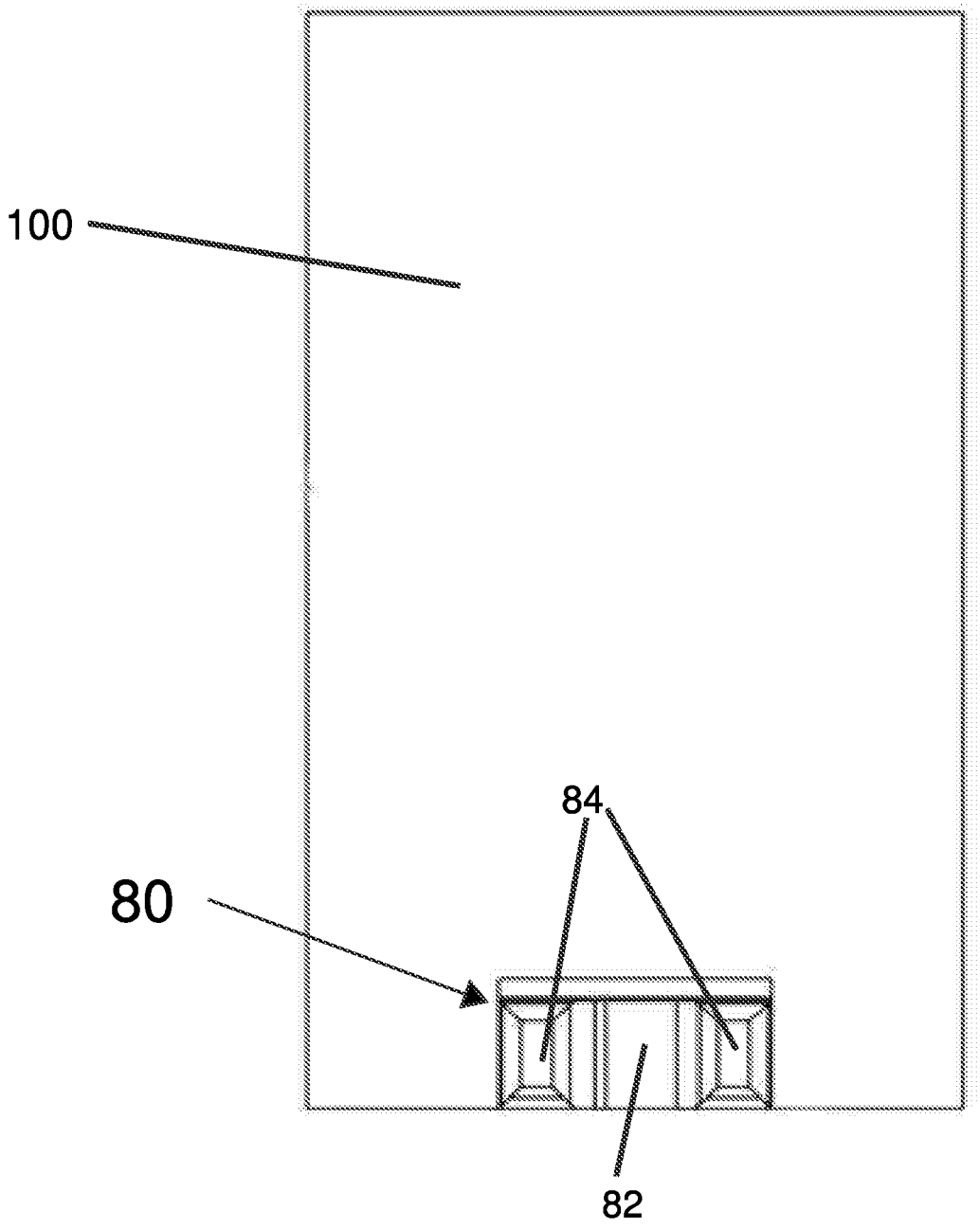
FIG. 9C is the front view of the third method to connect the playhouse to the door.

FIG. 9 is a perspective view of a third method to attach the pole 16 to the door 12. FIG. 9A is a top view of the third method to fasten the pole 16 to the door 12. FIG. 9B is a side view of the method of FIG. 9. FIG. 9C is the front view of the third method to connect the pole 16 to the door 12. FIGS.

9, 9A, 9B, and 9C shows a plate 100 that attaches to door 12 with a damage-free hanging adhesive 102. In the preferred embodiment plate 100 has a damage free hanging adhesive 102 made by 3M Company Command Brand™. Attached to the front of plate 100 is pole holder 80. Pole holder clip 80 has semicircular back section 82 and arms 84 that are resilient and extends forward from back section 82, as shown in FIGS. 9, 9A, 9B, and 9C. The pole 16 snaps between arms 84 and into the circular opening that is formed by back section 82 and arms 84. To attach the pole 16, the pole 16 is pushed through the opening between the resilient arms 84 and the resilient arms 84 moves outward and then inward fully encircling the pole 16. For more support, plate 100 with pole holder clip 80 can be attached to the bottom of the door 12 and pole 16.

Figure 10:
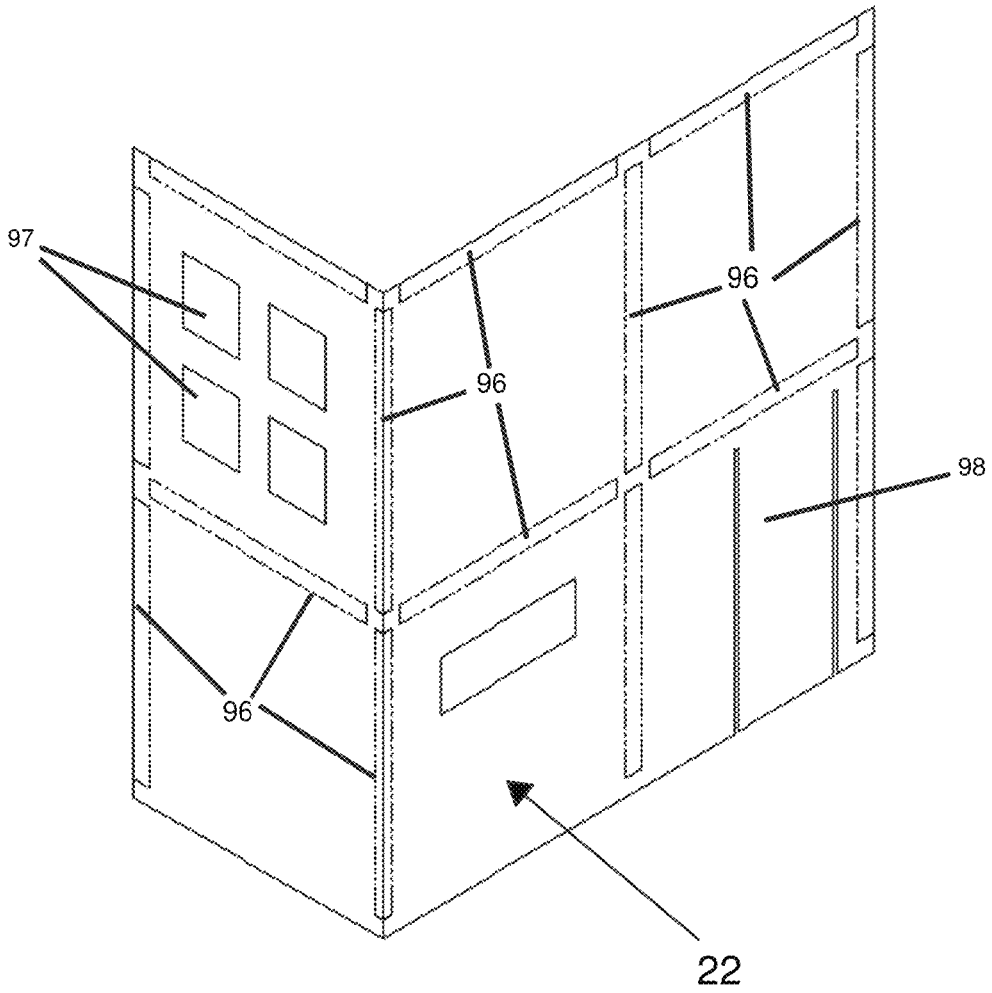
FIG. 10 is a view of the fabric that covers the panels.

The side pieces 16, 26, 28, 34, 54, 56, 58, 74, 76, and 78 in the preferred embodiment are fiberglass tubes. The T connector clamps 38 are also made of hard plastic. Fabric 22 is stretched over panels. In the preferred embodiment, the fabric 22 is high quality or ripstop nylon. FIG. 10 shows fabric 22. In FIG. 10 the small channels 96 shown in phantom are sewn into the fabric 22 for the side pieces 16, 26, 28, 34, 54, 56, 58, 74, 76, and 78 to pass through. The fabric 22 is printed with the designs. The fabric 22 can also be cut out to form doors 98, windows 97, etc. as shown in FIG. 10. The design could be a generic playhouse with doors and windows. Or the design could have a specific theme such as a fire station, a castle, a police station, a farm, etc.

I claim:

1. A playhouse that attaches to a door comprising:

a) a first panel; and, b) a means for attaching the first panel to the door that allows the first panel to rotate 180° such that the first panel can be mounted on either side of the door and can swing away from the door for play and towards the door for storage, and said means allows the first panel to be attached and removed from the door without damaging the door.

2. The playhouse that attaches to a door as in claim 1 wherein:

a) the first panel comprises:

1) a frame comprising;

i) poles; and, ii) clamps for attaching the poles to each other;

2) material that covers the frame.

3. The playhouse that attaches to a door as in claim 2 wherein:

a) the means for attaching the panel to the door comprises:

1) a first U-shaped bracket placed over the door; and, 2) a first clip attached to the first U-shaped bracket; and, 3) an attaching pole which is one of the poles of the frame attached to the first clip; and, 4) clamps of the frame that rotatably attach the poles of frame to the attaching pole.

4. The playhouse that attaches to a door as in claim 3 wherein:

a) the means for attaching the panel to a door further comprises:

1) a thumb screw that can tighten the first U-shaped bracket against the door.

5. The playhouse that attaches to a door as in claim 3 wherein:

a) the first clip comprises:

1) a back that permanently attaches to the U-shaped bracket; and, 2) two resilient arms that extend outward from the back and with the back form a circular area whose diameter is approximately the same as the attaching pole and said arms extend outward from the circular opening past the pole to form a second area which is a wedge-shaped aperture; and, 3) wherein the attaching pole is thrust into the wedge-shaped aperture and between the resilient arms and the resilient arms move outward and then inward substantially encircling the attaching pole to securely hold the attaching pole in place.

6. The playhouse that attaches to a door as in claim 3 further comprising:

a) a second U-shaped bracket placed under the door; and, 1) a second clip attached to the second U-shaped bracket; and, 2) the attaching pole that is thrust into the first clip is thrust into the second clip.

7. The playhouse that attaches to a door as in claim 6 wherein:

a) the second clip comprises:

1) a back that permanently attaches to the second U-shaped bracket; and, 2) two resilient arms that extend outward from the back attach to the second U-shaped bracket and with the back and the two resilient arms form a circular area whose diameter is approximately the same as the attaching pole and said arms extend outward from the circular area past the pole to form a wedge-shaped aperture; and, 3) wherein the attaching pole that is attached to the first U-shaped bracket is thrust into the wedge-shaped aperture between the resilient arms of the second clip and the resilient arms move outward and then inward substantially encircling the attaching pole to securely hold the attaching pole in place.

8. The playhouse that attaches to a door as in claim 3 wherein:

a) the frame comprises:

1) a top pole with ends; and, 2) a side poles, with a top; and, 3) the attaching pole with a top; and, 4) clamps for each end of the top pole; and, 5) the top of the side pole and the attaching pole attach to ends of the top pole by the side pole and the attaching pole attaching to one of the clamps on the ends of the top pole;

6) a reinforcement pole placed between the side pole and the attaching pole to buttress the frame; and, 7) clamps on each end of the reinforcement pole; and, 8) the side pole and the attaching pole attach to the ends of the reinforcement pole by the side pole and the attaching pole attaching to one of the clamps on the ends of the reinforcement pole.

9. The playhouse that attaches to a door as in claim 2 wherein:

a) each clamp has a top end and bottom end and is a piece of material with a bore at the top end, and said bore is of a size that can hold any of the poles securely and at the bottom end of the piece of material is a cylindrical opening that is perpendicular to the bore and passes completely through the piece of material and the bottom end of the piece of material is cut to truncate the cylindrical opening and to create a gap at the bottom end of the piece of material, and the cylindrical opening is of a size that encircles the pole significantly more than 180° and the cylindrical opening will securely hold one of the poles in place and due to the gap the pole can twist in the cylindrical opening.

10. The playhouse that attaches to a door as in claim 2 wherein:

a) the means for attaching the panel to the door comprises:

1) a first plate; and, 2) a means for attaching the first plate to the door and removing from the door without damaging the door; and, 3) a first clasp attached to the first plate; and, 4) an attaching pole which is one of the poles of the frame attached to the first clasp; and, 5) clamps of the frame that rotatably attach the frame to the attaching pole.

11. The playhouse that attaches to a door as in claim 10 wherein:

a) the means for attaching the first plate to the door and removing from the door without damaging the door is a damage-free hanging adhesive.

12. The playhouse that attaches to a door as in claim 10 wherein:

a) the first clasp comprises:

1) a posterior plate that permanently attaches to the first plate; and, 2) two resilient arms that extend outward from the posterior plate and with the posterior plate form a circular area whose diameter is approximately the same as the attaching pole and said arms extend outward from the circular area past the pole to form a wedge-shaped aperture; and, 3) wherein the attaching pole is thrust into the wedge-shaped aperture between the resilient arms and the resilient arms move outward and then inward substantially encircling the attaching pole to securely hold the attaching pole in place.

13. The playhouse that attaches to a door as in claim 10 further comprising:

a) a second plate that is placed at the bottom of the door; and, b) a second clasp attached to the second plate; and, c) the attaching pole that is thrust into the first clasp of the first plate is thrust into the second clasp.

14. The playhouse that attaches to a door as in claim 13 wherein:

a) the second clasp comprises:

1) a posterior plate that permanently attaches to the second plate; and, 2) two resilient arms that extend outward from the posterior plate and with the posterior plate form a circular area whose diameter is approximately the same as the attaching pole and said arms extend outward from the circular area past the pole to form a wedge-shaped aperture; and, 3) wherein the attaching pole that attaches to the first clasp is thrust into the wedge-shaped aperture of the second clasp between the resilient arms, and the resilient arms move outward and then inward substantially encircling the attaching pole and attaches the frame to the door.

15. A playhouse that attaches to a door comprising:

a) a first panel; and b) a means for attaching the first panel to the door that allows the first panel to swing away from the door and away from the wall or door opening for play and towards the door for storage, and said means allows the first panel to be attached and removed from the door without damaging the door; and, c) a second panel; and, d) a first hinging system that hinges the first panel to the second panel that allows the second panel to rotate at least 270° away from the first panel to form an enclosure such that the second panel is parallel to the door and at a right angle to the first panel and can rotate back towards the first panel to 0° when the first panel is swung towards the door for storage.

16. The playhouse that attaches to a door as in claim 15 further comprising:

a) a third panel; and, b) a second hinging system that hinges the second panel to the third panel that allows the third panel to rotate at least 90° away from the second panel to form an enclosure, and can rotate back against the second panel when the second panel is swung towards the door for storage.

17. The playhouse that attaches to a door as in claim 16 wherein:

a) the second hinging system that hinges the second panel to the third panel comprises:

1) the second panel and the third panel have a second common side pole; and, 2) the second panel has a top pole and a reinforcement pole; and, 3) the third panel has a top pole and a reinforcement pole: and, 4) the top pole of the second panel attaches to the second common side pole with a fastener; and, 5) the top pole of the third panel attaches to the second common side pole with a fastener; and, 6) the reinforcement pole of the second panel attaches to the second common side pole with a fastener; and, 7) the reinforcement pole of the third panel attaches to the second common side pole with a fastener.

18. The playhouse that attaches to a door as in claim 17 wherein:

a) each of the fasteners has a top end, and bottom end and is a piece of material with a bore at the top end, and said bore is of a size that can hold any of the poles securely and at the bottom end of the piece of material is a cylindrical opening that is perpendicular to the bore and passes completely through the piece of material and the bottom end of the piece of material is cut to truncate the cylindrical opening and to create a gap at the bottom end of the piece of material and the cylindrical opening is of a size that that encircles the common side pole significantly more than 180° and the cylindrical opening will securely hold the second common side pole in place and due to the gap, the second common side pole can twist in the cylindrical opening.

19. The playhouse that attaches to a door as in claim 15 wherein:

a) the first hinging system that hinges the first panel to the second panel comprises:

1) the first panel and the second panel have a common side pole; and, 2) the first panel has a top pole and a reinforcement pole; and, 3) the second panel has a top pole and a reinforcement pole: and, 4) the top pole of the first panel attaches to the common side pole with a fastener; and, 5) the top pole of the second panel attaches to the common side pole with a fastener; and, 6) the reinforcement pole of the first panel attaches to the common side pole with a fastener; and, 7) the reinforcement pole of the second panel attaches to the common side pole with a fastener.

20. The playhouse that attaches to a door as in claim 19 wherein:

a) each of the fasteners has a top end, and bottom end and is a piece of material with a bore at the top end, and said bore is of a size that can hold any of the poles securely and at the bottom end of the piece of material is a cylindrical opening that is perpendicular to the bore and passes completely through the piece of material and the bottom end of the piece of material is cut to truncate the cylindrical opening and to create a gap at the bottom end of the piece of material and the cylindrical opening is of a size that encircles the common side pole significantly more than 180° and the cylindrical opening will securely hold the common side pole in place and due to the gap, the common side pole can twist in the cylindrical opening.

* * * * *